US010590624B2

(12) United States Patent
Gundupalli

(10) Patent No.: US 10,590,624 B2
(45) Date of Patent: Mar. 17, 2020

(54) MOTOR GRADER CIRCLE DRAWBAR ASSEMBLY

(71) Applicant: Deere & Company, Moline, IL (US)

(72) Inventor: John Vikram Gundupalli, Pune (IN)

(73) Assignee: DEERE & COMPANY, Moline, IL (US)

( * ) Notice: Subject to any disclaimer, the term of this patent is extended or adjusted under 35 U.S.C. 154(b) by 76 days.

(21) Appl. No.: 15/784,406

(22) Filed: Oct. 16, 2017

(65) Prior Publication Data

US 2019/0112782 A1 Apr. 18, 2019

(51) Int. Cl.
*E02F 3/84* (2006.01)
*E02F 3/76* (2006.01)

(52) U.S. Cl.
CPC ..... *E02F 3/844* (2013.01); *E02F 3/764* (2013.01)

(58) Field of Classification Search
CPC ..... E02F 3/844; E02F 3/764
USPC ..... 172/796
See application file for complete search history.

(56) References Cited

U.S. PATENT DOCUMENTS 1,844,058 A * 2/1932 Dean ..... E02F 3/844 172/796
3,028,699 A * 4/1962 Greeley ..... E02F 3/764 172/796
3,512,589 A * 5/1970 Ulrich ..... E02F 3/764 172/430
3,721,303 A * 3/1973 Hanser ..... E02F 3/764 172/792
4,061,194 A * 12/1977 McCanse ..... E02F 3/7627 172/260.5
4,161,987 A 7/1979 Tolmer
6,758,286 B2 * 7/2004 Walker ..... E02F 3/7636 172/791
8,291,999 B2 * 10/2012 Howson et al. ..... E02F 3/7668 172/796
9,228,316 B2 1/2016 Staade et al.

FOREIGN PATENT DOCUMENTS

FR 2268122 A2 11/1975

* cited by examiner

*Primary Examiner* — Thomas B Will
*Assistant Examiner* — Joel F. Mitchell

(57) ABSTRACT

A motor grader includes a work implement supported by a frame, a controller, and a circle drawbar assembly for controlling the work implement. The circle drawbar assembly includes a drawbar frame, a circle member coupled to the drawbar frame, and a drive arrangement coupled to the drawbar frame and the circle member for rotation thereof about the circle axis. The drawbar arrangement a first hydraulic cylinder and a second hydraulic cylinder pivotally coupled to the drawbar frame at a first location and a second location, respectively, on their respective first portions, and pivotally coupled to the circle member at a common third location on their respective second portions. A control arrangement extends and retracts the hydraulic cylinders in timed relationship to rotate the circle member about the circle axis.

12 Claims, 6 Drawing Sheets

MOTOR GRADER CIRCLE DRAWBAR ASSEMBLY

CROSS-REFERENCE TO RELATED APPLICATIONS

N/A

BACKGROUND

Work vehicles, such as a motor grader, can be used in construction and maintenance for creating a flat surface. When paving a road, a motor grader can be used to prepare a base foundation to create a wide flat surface for asphalt to be placed on. A motor grader can include two or more axles, with an engine and cab disposed above the axles at the rear end of the vehicle. A blade is attached to the vehicle between the front axle and the rear axle.

Motor graders include a circle drawbar assembly attached near the nose of the grader which is pulled by the grader as it moves forward. The drawbar frame rotatably supports a circle member at a free end of the drawbar frame and the circle member supports a work implement such as the blade. The angle of the work implement beneath the drawbar frame can be adjusted by the rotation of the circle member relative to the circle drawbar assembly.

In some conventional motor graders, the circle drive members are supported by a series of bearings attached to the drawbar and the circle drive member includes a series of gear teeth disposed to the exterior circle member or disposed to the interior of the circle member. These gear teeth cooperate with one or more drive gears associated with drive motors attached to the drawbar frame. In other conventional motor graders, a worm driven gear box can be mounted to a drawbar frame of the grader and which rotates pinion gears which mesh with the large ring gear of the circle drive member.

In conventional motor graders, the use of a gear box has limitations. For instance, the gear box can be inefficient and thereby limiting the amount of available power to drive the work implement. Some alternative solutions have incorporated a hydraulic cylinder, which is more efficient than the gear box. Past proposed configurations using multiple hydraulic cylinders, however, have limitations whereby the cylinders can only rotate the circle so far before the cylinders either crossover one another or cannot continue rotation. Occasionally, the cylinders are not operating in optimal positions and thus need to be repositioned during operation to achieve their full mechanical advantage over the conventional gear box arrangement.

Therefore, a need exists for a new configuration of a circle drawbar assembly of a motor grader to be driven by hydraulic cylinders with optimal positioning, movement, and functionality.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The circle drawbar assembly for a motor grader may comprise a drawbar frame, a circle member coupled to the drawbar frame for rotation about the circle axis, a drive arrangement coupled to the drawbar frame and the circle member for rotation thereof about the circle axis. The drive arrangement may comprise a first hydraulic cylinder, a second hydraulic cylinder pivotally coupled to the drawbar frame at a first location and second location, respectively, on their first portions and pivotally coupled to circle member at a common third location on the their respective second portions. The circle drawbar assembly may further comprise a control arrangement for extending and retracting the hydraulic cylinders in timed relationship to rotate the circle member about the circle axis.

The third location may be offset from the circle axis. The third location may also follow a radial path of travel about the circle axis. The first and second locations may be stationary.

The control arrangement may further comprise a two-bar linkage pivotally coupled to the third location and the drawbar frame.

The circle drawbar assembly may further comprise hydraulic routings coupled to the two bar linkage.

The control arrangement may also comprise a timed signal from a controller to operatively control the extension and retraction of the first hydraulic cylinder and the second hydraulic cylinder.

The circle drawbar assembly may also be configured to lock the position of the circle member when the hydraulic cylinders are not used to rotate the circle member. The circle member may also be configured to rotate about the circle in at least one of a clockwise or a counterclockwise direction.

These and other features will become apparent from the following detailed description and accompanying drawings, wherein various features are shown and described by way of illustration.

BRIEF DESCRIPTION OF THE DRAWINGS

The detailed description of the drawings refers to the accompanying figures in which.

DETAILED DESCRIPTION

The embodiments described below are not intended to be exhaustive or limiting to the precise forms in the following detailed description. Rather, the embodiments are chosen and described so that others skilled in the art may appreciate and understand the principles and practices presented.

Figure 1:
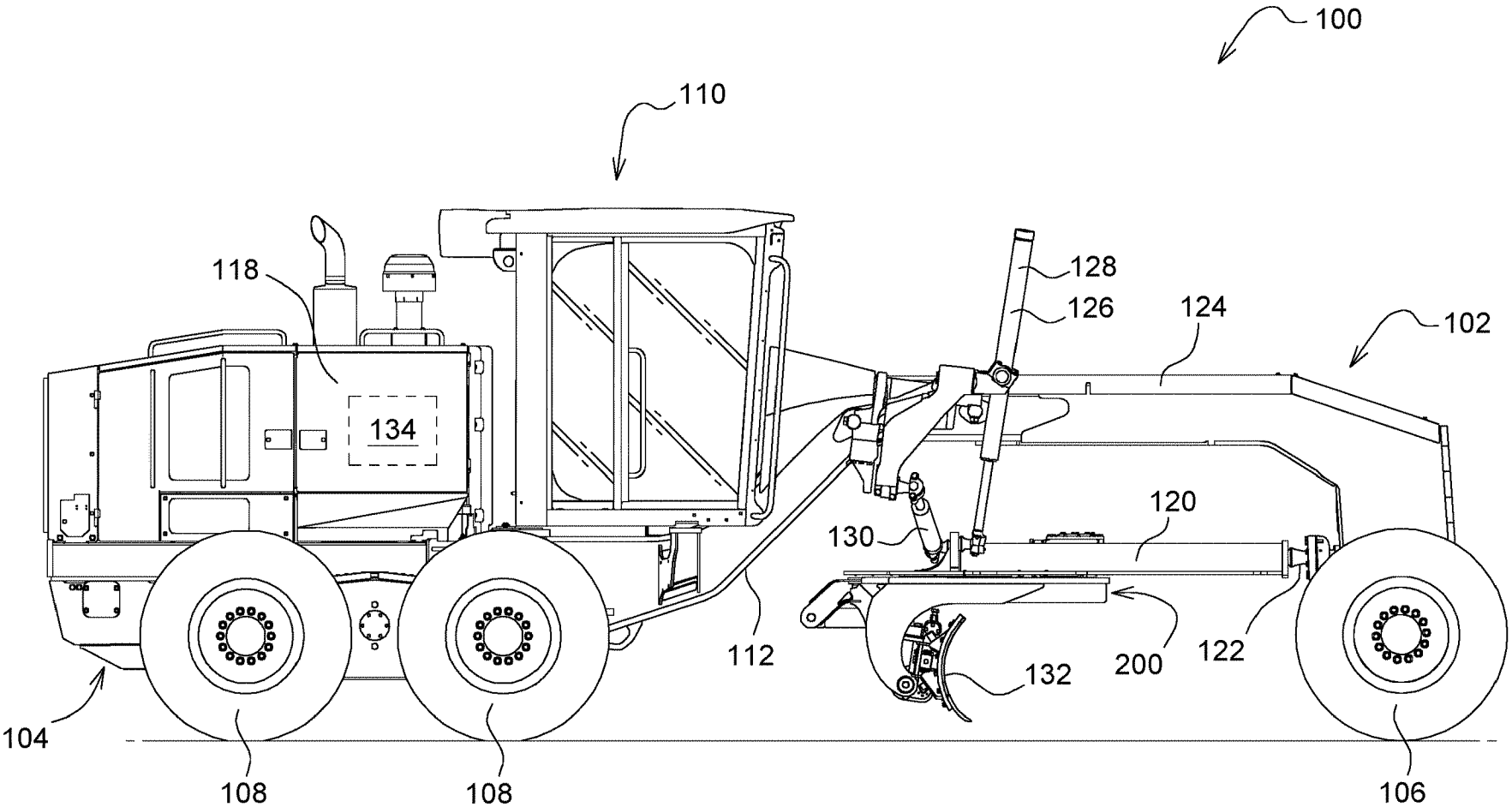
FIG. 1 is a side view of a motor grader.

FIG. 1 illustrates an exemplary embodiment of a machine, such as a motor grader 100. An example of a motor grader is the 772G Motor Grader manufactured and sold by Deere & Company. As shown in FIG. 1, the motor grader 100 includes front and rear frames 102 and 104, respectively, with the front frame 102 being supported on a pair of front wheels 106, and with the rear frame 104 being supported on right and left tandem sets of rear wheels 108. An operator cab 110 is mounted on an upwardly and forwardly inclined rear region 112 of the front frame 102 and contains various controls for the motor grader 100 disposed so as to be within reach of a seated or standing operator. In one aspect, these controls may include a steering wheel (not shown) and a lever assembly (not shown). An engine 118, for example, is mounted on the rear frame 104 and supplies power for all driven components of the motor grader 100. The engine 118, for example, can be configured to drive a transmission (not shown), which is coupled for driving the rear wheels 108 at various selected speeds and either in forward or reverse modes. A hydrostatic front wheel assist transmission (not shown) may be selectively engaged to power the front wheels 106, in a manner known in the art.

Mounted to a front location of the front frame 102 is a drawbar frame 120, having a forward end universally connected to the front frame 102 be a ball and socket arrangement 122 and having opposite right and left rear regions suspended from an elevated central section 124 of the front frame 102 by right and left lift linkage arrangements including right and left extensible and retractable hydraulic actuators 126 and 128, respectively. A side shift linkage arrangement is coupled between the elevated frame section 124 and a rear location of the drawbar 120 and includes an extensible and retractable side swing hydraulic actuator 130. A work implement, such as a blade 132, is coupled to the front frame 102 and controlled by a circle drawbar assembly 200.

Figure 2:
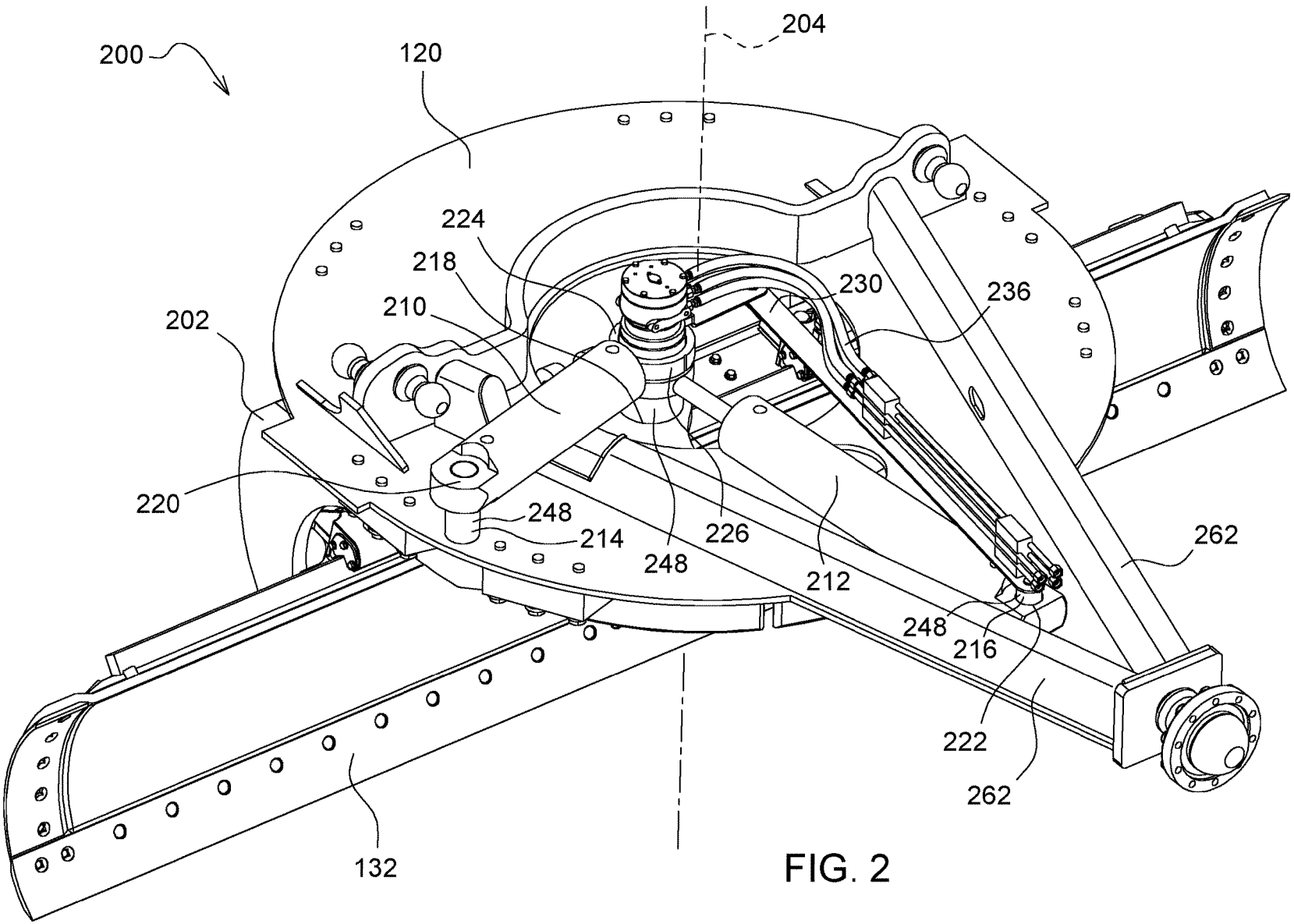
FIG. 2 is a perspective view of a circle drawbar assembly per one embodiment.
Figure 3:
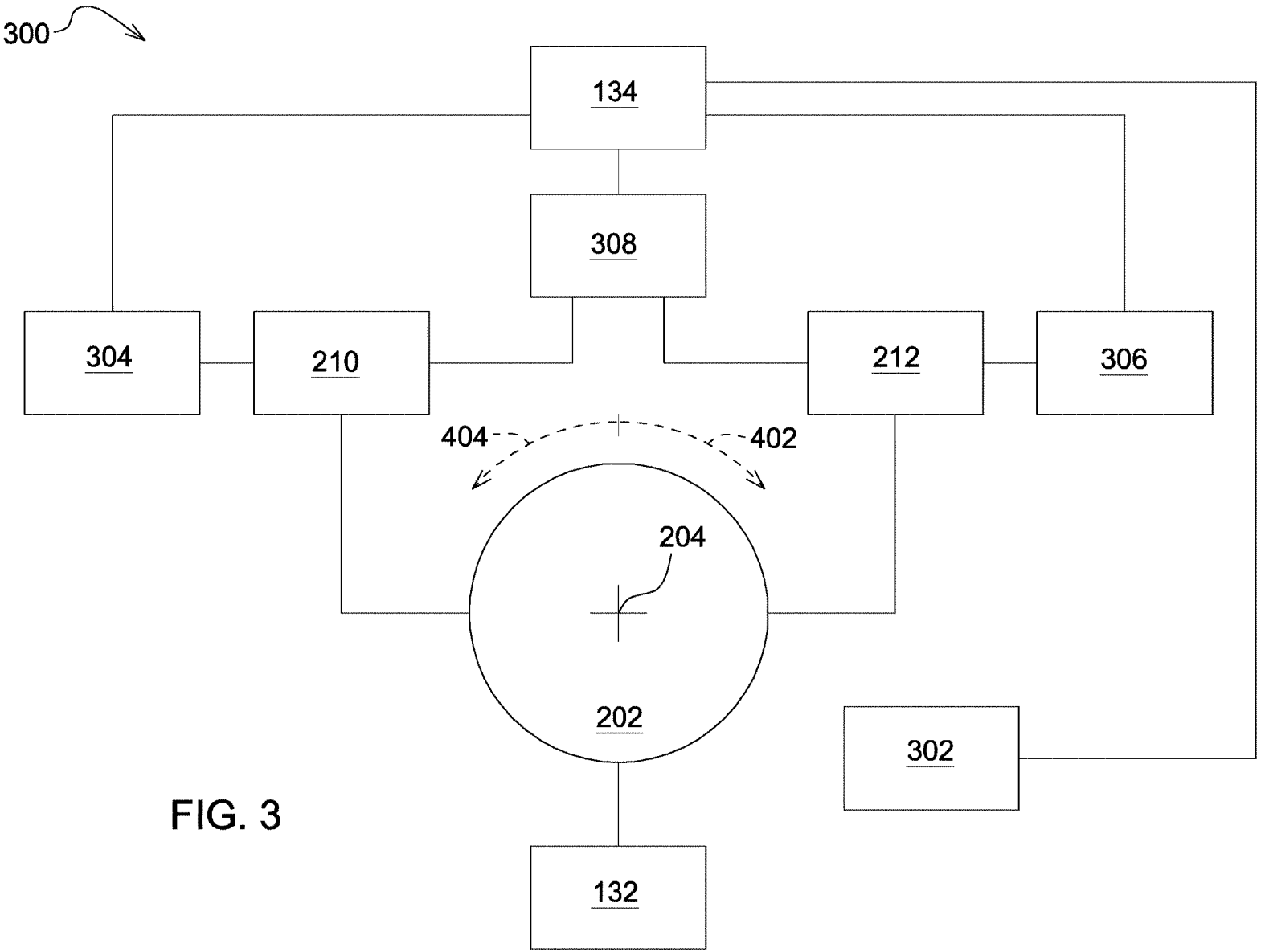
FIG. 3 is a flowchart of a control arrangement for the circle drawbar assembly.
Figure 4A:
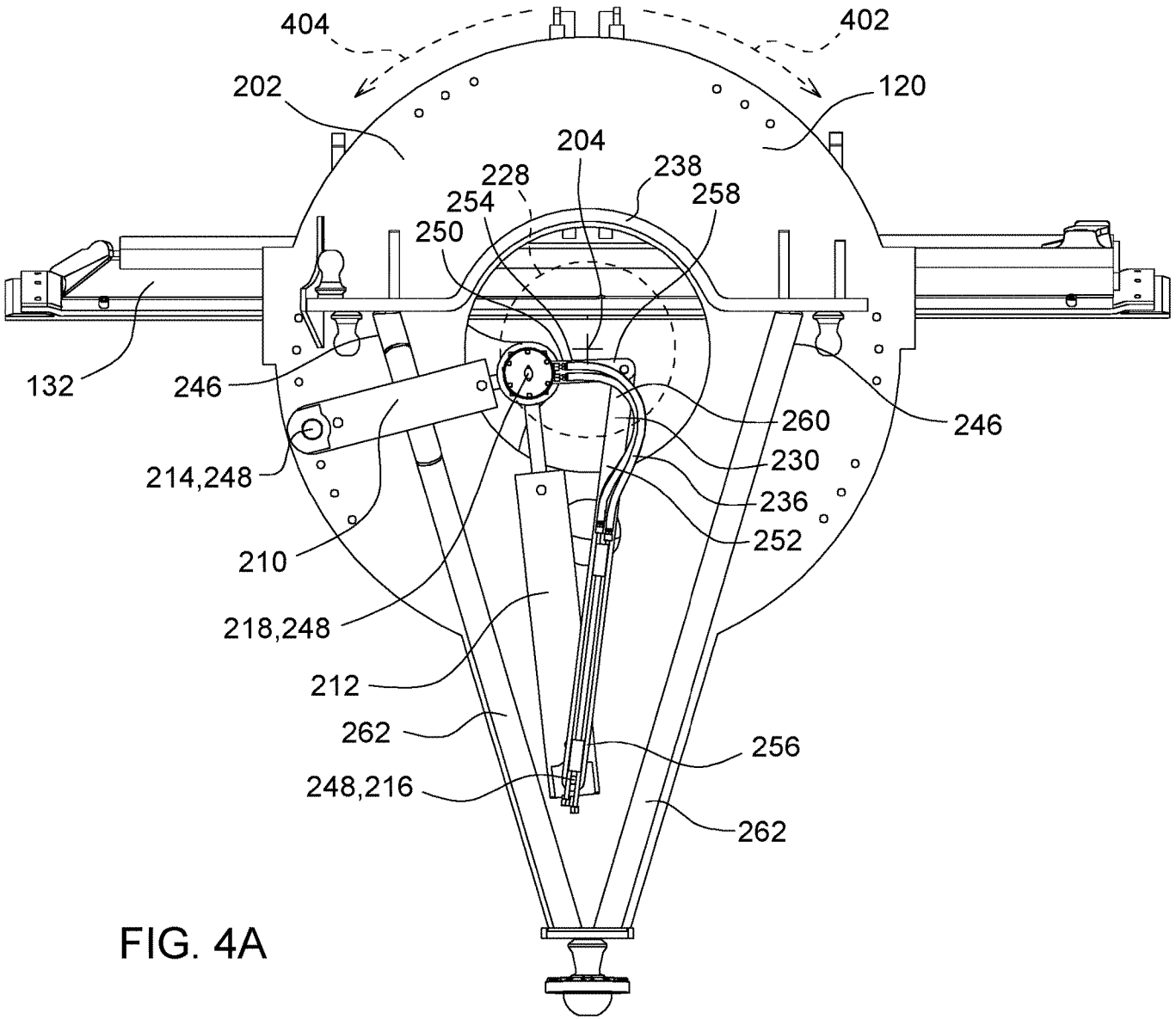
FIG. 4*a* is a top view of the circle drawbar assembly in a first position.
Figure 4B:
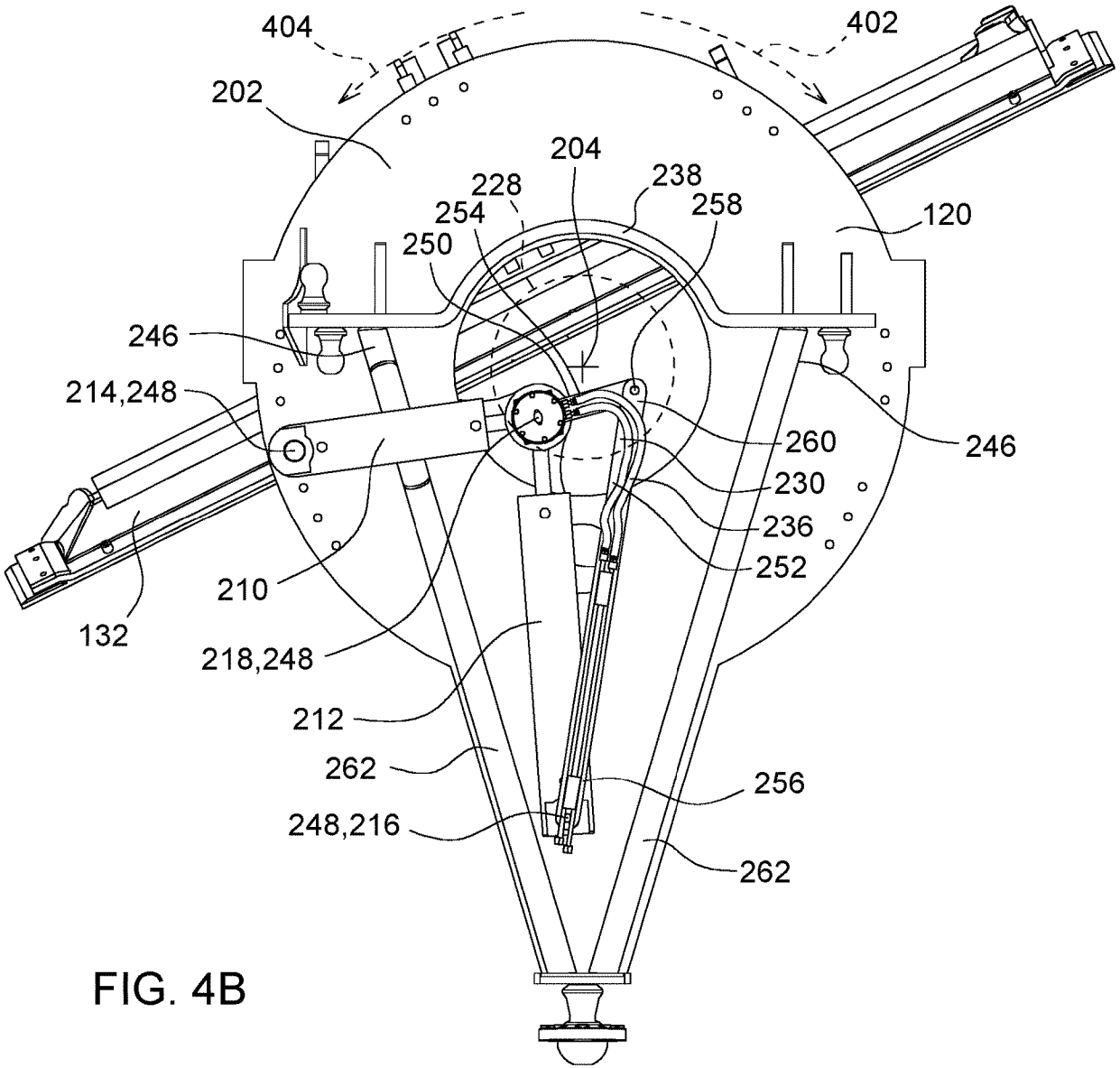
FIG. 4*b* is a top view of the circle drawbar assembly in a second position.
Figure 5:
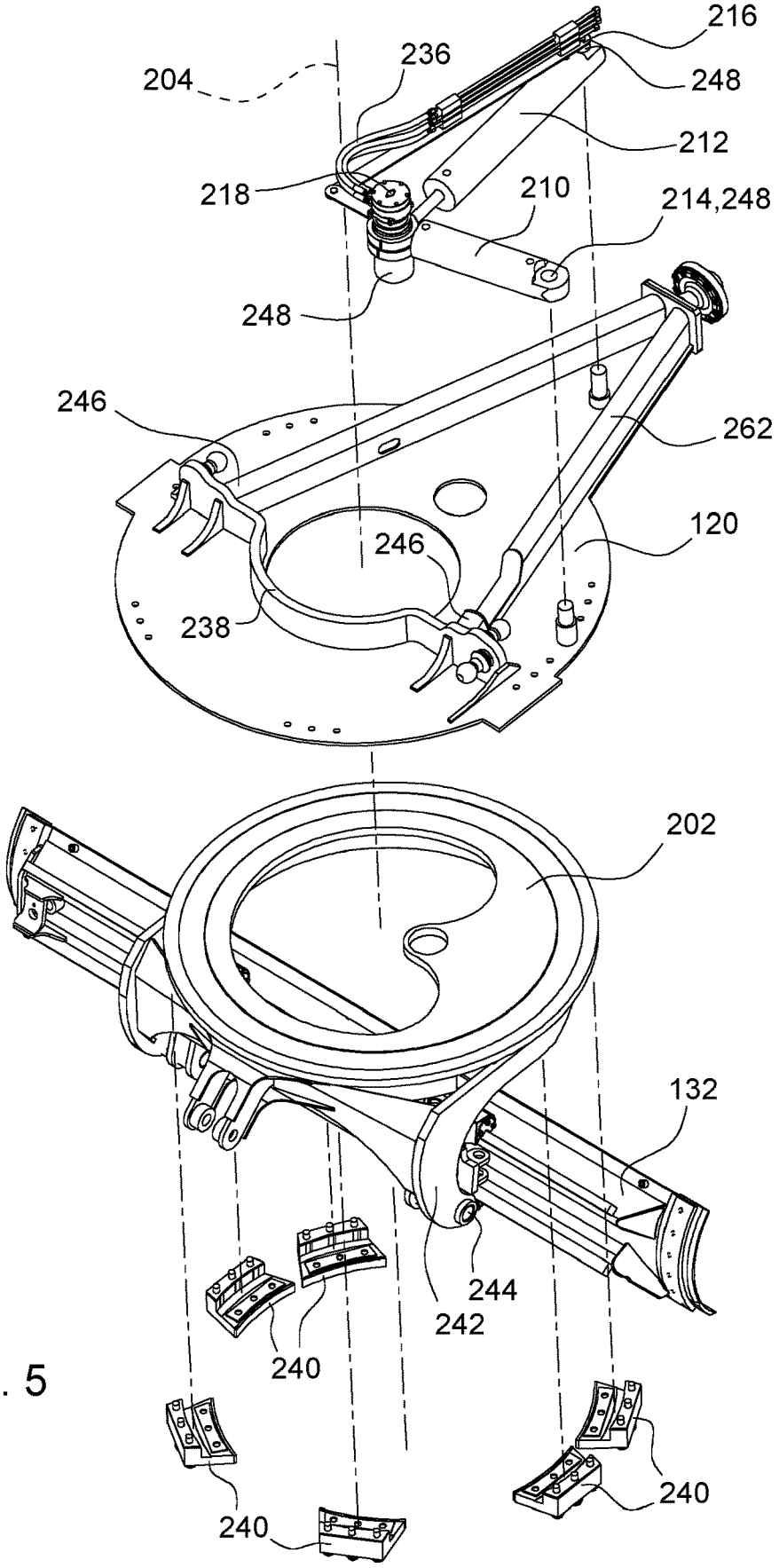
FIG. 5 is an exploded view of the circle drawbar assembly

Referring to FIG. 2, an exemplary embodiment of a circle drawbar assembly 200 for a motor grader 100 is shown. The circle drawbar assembly 200 may comprise a drawbar frame 120; a circle member 202 coupled to the drawbar frame 120 for rotation about a circle axis 204; a drive arrangement (components described below) coupled to the drawbar frame 120 and the circle member 202 for rotation thereof about the circle axis 204; and a control arrangement 300 (one embodiment is shown in FIG. 3) for extending and retracting hydraulic cylinders (210, 212) in timed relationship to rotate the circle member 202 about the circle axis 204. The circle axis 204 is the center point of the circle member 202. The circle member 202 may further comprise a substantially C-shaped structure 242 at a connection point 244 (shown in FIG. 5) to allow a motor grader operator to pitch a work implement forwards and backwards. Alternatively, the work implement (e.g. blade 132) may be directly coupled to the substantially C-shaped structure 242. As seen in FIGS. 4*a* and 4*b*, the drawbar frame 120 further comprises a generally V-shaped portion 262 and a cross-member 238 coupling the two free ends 246 of the V-shaped portion 262 of the drawbar frame 120. Bearings 240 (shown in FIG. 5) engage the circle member 202 at a series of points spaced about the circle member 202. FIG. 5 is an exploded view of a circle drawbar assembly 200.

In one embodiment, the drive arrangement includes a first hydraulic cylinder 210 and second hydraulic cylinder 212 pivotally coupled to the drawbar frame 120 at a first location 214 and a second location 216, respectively, on their respective first portions (220, 222) and pivotally coupled to the circle member 202 at a common third location 218 on their respective second portions (224, 226). In this particular embodiment, the first hydraulic cylinder 210 and the second hydraulic cylinder 212 are pivotally coupled through a shaft 248 in at least one of the first location 214, the second location 216, and the third location 218. Although this may be one means of pivotally coupling, other alternatives not described in detail are available. Regarding the third location 218, pivotally coupling the first hydraulic cylinder 210 and the second hydraulic cylinder 212 at a common third location 218, or more particularly, to a common shaft 248 overcomes any issues that may arise with respect to interference between the hydraulic cylinders (210, 212) and attachments to the hydraulic components. The shafts 248 may be hollow, thereby advantageously providing passageways for any wiring, hoses, or hydraulic routings 236 (e.g. for blade side shift and circle side shift cylinders). The aforementioned configuration, advantageously, allows for the circle member 202 to rotate about the circle axis 204 three hundred sixty degrees infinitely in either the clockwise 402 or counterclockwise 404 directions (shown in FIGS. 4*a* and 4*b*) for reasons further discussed below.

In one embodiment, as shown in FIG. 2, the first location 214 is stationary as defined by the position of the first location 214 relative to the circle axis 214 when the circle member 202 rotates about the circle axis 204. This remains true of the second location 216 as well. That is, the second location 216 is also be stationary when the circle member 202 rotates about the circle axis 204.

The third location 218 may be offset from the circle axis 204. Contrary to the first location 214 and the second location 216, the third location 218 may follow a radial path of travel 228 about the circle axis 204 (as shown by the dotted line in FIG. 4*a* and FIG. 4*b*) as the circle member 202 rotates about the circle axis 204.

Now referring to FIG. 2, FIG. 4*a* and FIG. 4*b*, in one embodiment, the control arrangement 300 of the circle drawbar assembly 200 may further comprise a two-bar linkage 230 pivotally coupled to the third location 218 and the drawbar frame 120. The two-bar linkage 230 comprises a first bar 250 and a second bar 252 wherein the first bar 250 is pivotally coupled to the circle member 202 at the third location 218 on a first portion of the first bar 254; the second bar 252 is pivotally coupled to the drawbar frame 120 on a first portion of the second bar 256; and the first bar 250 and the second bar 252 are pivotally coupled wherein a second portion of the first bar 258 and a second portion of the second bar 260 link to one another. Again, as previously described, pivotal coupling of components may be shown via a shaft 248. However, this is one of several means of coupling although only this embodiment is shown here. The two-bar linkage 230 provides a mechanical support means, and control arrangement for the radial path of travel 228 of the third location 218. This mechanical support means can either by a primary or secondary support measure in the event of failure of a hydraulic cylinder where a cylinder loses function (e.g. due to mechanical failure, controller failure, debris in hydraulic fluid, etc.).

The circle drawbar assembly 200 may further comprise hydraulic routings 236 coupled to the two-bar linkage 230. The two-bar linkage 230 provides a support surface for hydraulic routings 236, thereby positioning the hydraulic routings 236 above moving components and minimizing any risk of entangling hydraulic routing components (e.g. fluid tubes, hoses, electrical wiring, air pressure lines, etc.). This support surface provides an area for coupling the hydraulic routings 236 to the hydraulic cylinders (210, 212) wherein the configuration described above allows for an unlimited number of turns of the circle member 202 about the circle axis 204 in a single direction, either clockwise 402 or counterclockwise 404 without the risk of hydraulic routings 236 breakage or entanglement.

FIGS. 4*a* and 4*b* demonstrate the hydraulic cylinders (210, 212) in different positions and the circle member 202 has been rotated beneath the drawbar frame 120. Now turning to FIG. 3, the control arrangement 300 may also comprise a timed signal from a controller 134 (also shown in FIG. 1) to operatively control the extension and retraction of the first hydraulic cylinder 210 and the second hydraulic cylinder 212. The timed signal is used to control the supply and return of hydraulic fluid to the hydraulic cylinders (210, 212). In one embodiment, these hydraulic cylinders (210, 212) may be two-way cylinders. A control arrangement 300 comprising a timed signal from a controller 134 for controlling a drawbar assembly is shown. Rotation of the circle member 202 of the circle drawbar assembly can be driven by the first hydraulic cylinder 210 and the second hydraulic cylinder 212. The circle member 202 is configured to rotate in at least one of a clockwise 402 and counterclockwise direction 404 (also shown in FIGS. 4*a* and 4*b*). The circle member 202 can change the pitch angle of a work implement such as a blade 132. To control the positioning of each hydraulic cylinder (210, 212), a sensing mechanism or rotation sensor 302 can be provided to detect rotational movement of the circle member 202. The sensing mechanism or rotation sensor 302 may comprise one or more switches that detect movement, speed, or position of the circle member 202. The rotational sensor 302 can be electrically coupled to the controller 134 and be in communication or contact with the circle member relative 202 relative to the circle axis 204. Alternatively, the sensor 302 may encode the circle member 202 similar to a wheel sensor or crankshaft position sensor and communicate position information to the controller 134.

Moreover, a first position sensor 304 can be provided to detect the relative position of the first hydraulic cylinder 210 (e.g. its stroke length). A second position sensor 306 can be provided to detect the relative position of the second hydraulic cylinder 212. The first position sensor 304 and the second position sensor 306 can be electrically coupled to the controller 134 to communicate the stroke length or position of each cylinder (210, 212). In turn, the controller 134 can have a memory unit that stores readable instructions including logic. The controller 134 can adjustably control the control valve 308 to control each hydraulic cylinder (210, 212).

In an alternative aspect, the control arrangement of FIG. 3 may not include a sensing mechanism or rotation sensor 302. Instead the controller 134 may only receive feedback from one or both position sensors (304, 306). Based on these signals, the controller 134 can control rotational movement of the circle member 202 based on the measured stroke length of each hydraulic cylinder (210, 212).

In yet another embodiment, a pressure sensing mechanism (not shown) or device for each hydraulic cylinder (210, 212) can be in electrical communication with the controller 134. In this instance, the controller 134 can interpret or determine when one of the hydraulic cylinders (210, 212) reaches its maximum stroke length based on a pressure spike sensed by the pressure sensing mechanism or device. Here, as the hydraulic cylinder (210, 212) reaches its maximum stroke length and any additional pressure command results in a pressure spike, the controller 134 can interpret or detect that the corresponding hydraulic cylinder (210, 212) is at its maximum stroke length. Other known methods and sensing mechanisms may be incorporated into the control arrangement 300 of FIG. 3 for determining cylinder rod stroke length, position of the circle member relative to the circle axis, or both.

Furthermore, when the hydraulic cylinders (210, 212) are not used to rotate the circle member 202, the hydraulic cylinders (210, 212) may be configured to lock the position of the circle member 202. Once the circle member 202 has been rotated to the desired position, the movement of additional hydraulic fluid to the hydraulic cylinders (210, 212) may be blocked by the control valve, or other means. In this way, each of the hydraulic cylinders (210, 212) acts as a lock against further movement of the circle member 202. This provides positive hydraulic locking of the circle member 202 relative to the drawbar frame 120. The cylinders (210, 212) and their pivotally coupling to the circle member 202 and the drawbar frame 120 can be designed to reduce wear. The various pivot points can be protected from the environment and are less prone to wear than the gear arrangement of current methods known by a person of skill in the art). Furthermore, the above described configuration advantageously provides substantial savings in the manufacturing cost where the cost of cutting and heat treating the "circle gear" is eliminated. Furthermore, the need for a worm drive, and hydraulic motor are also eliminated. The overall reduction in components results in greater inherent reliability as well.

While the above describes example embodiments, these descriptions should not be viewed in a restrictive or limiting sense. Rather, there are several variations and modifications which may be made without departing from the scope of the appended claims.

What is claimed is:

1. A circle drawbar assembly for a motor grader comprising:

a drawbar frame;

a circle member coupled to the drawbar frame for rotation about a circle axis;

a drive arrangement coupled to the drawbar frame and the circle member for rotation thereof about the circle axis;

wherein the drive arrangement comprises a first hydraulic cylinder and a second hydraulic cylinder pivotally coupled to the drawbar frame at a first location and a second location, respectively, on their first portions and pivotally coupled to the circle member at a common third location on their respective second portions; and a controller causing extension and retraction of the hydraulic cylinders in a timed relationship to rotate the circle member about the circle axis, and a two-bar linkage pivotally coupled to the circle member at the third location and the drawbar frame, the two-bar linkage comprising a first bar and a second bar wherein the first bar is pivotally coupled to the circle member at the third location on a first portion of the first bar, the second bar is pivotally coupled to the drawbar frame on a first portion of the second bar, and the first bar and the second bar are pivotally coupled wherein a second portion of the first bar and a second portion of the second bar link to one another, the two-bar linkage providing mechanical support to the hydraulic cylinders to guide the third location, the third location following a radial path about the circle axis, and further providing a support surface for coupling a hydraulic routing to the hydraulic cylinders.

2. The circle drawbar assembly of claim 1, wherein the third location is offset from the circle axis.

3. The circle drawbar assembly of claim 1, wherein the first location is stationary.

4. The circle drawbar assembly of claim 1, wherein the second location is stationary.

5. The circle drawbar assembly of claim 1 wherein the hydraulic cylinders are configured to lock the position of the circle member when the hydraulic cylinders are not used to rotate the circle member.

6. The circle drawbar assembly of claim 1, wherein the circle member is configured to rotate about the circle axis in at least one of a clockwise and a counterclockwise direction.

7. A motor grader comprising:

a frame supported above a surface by a plurality of wheels;

a blade supported by the frame and adapted to perform a desired operation;

a controller;

a circle drawbar assembly for controlling the blade, wherein the circle drawbar assembly comprises:

a drawbar frame;

a circle member coupled to the drawbar framed for rotations about a circle axis; and a drive arrangement coupled to the drawbar frame and the circle member for rotation thereof about the circle axis;

wherein the drawbar arrangement comprises a first hydraulic cylinder and a second hydraulic cylinder pivotally coupled to the drawbar frame at a first location and a second location, respectively, on their respective first portions and pivotally coupled to the circle member at a common third location on their respective second portions; and a controller causing extension and retraction of the hydraulic cylinders in a timed relationship to rotate the circle member about the circle axis, a two-bar linkage pivotally coupled to the circle member at the third location and the drawbar frame, the two-bar linkage comprising a first bar and a second bar wherein the first bar is pivotally coupled to the circle member at the third location on a first portion of the first bar, the second bar is pivotally coupled to the drawbar frame on a first portion of the second bar, and the first bar and the second bar are pivotally coupled wherein a second portion of the first bar and a second portion of the second bar link to one another, the two-bar linkage providing mechanical support to the hydraulic cylinders to guide the third location, the third location following a radial path about the circle axis, and further providing a support surface for coupling a hydraulic routing to the hydraulic cylinders.

8. The motor grader of claim 7, wherein the third common location is offset from the circle axis.

9. The motor grader of claim 7, wherein the first location is stationary.

10. The motor grader of claim 7, wherein the second location is stationary.

11. The motor grader of claim 7, wherein the hydraulic cylinders are configured to lock the position of the circle member when the hydraulic cylinders are not used to rotate the circle member.

12. The circle drawbar assembly of claim 7, wherein the circle member is configured to rotate about the circle axis in at least one of a clockwise and a counterclockwise direction.

* * * * *